US007628396B2

(12) United States Patent
Moore et al.

(10) Patent No.: US 7,628,396 B2
(45) Date of Patent: Dec. 8, 2009

(54) HIGH SPEED SHINGLED SHEET COMPILER

(75) Inventors: Steven R. Moore, Pittsford, NY (US); Paul J. Degruchy, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 224 days.

(21) Appl. No.: 11/689,290

(22) Filed: Mar. 21, 2007

(65) Prior Publication Data

US 2008/0230978 A1 Sep. 25, 2008

(51) Int. Cl.
*B65H 29/32* (2006.01)

(52) U.S. Cl. ..... 271/197; 271/194; 271/183

(58) Field of Classification Search ..... 271/182, 271/183, 194, 196, 197, 273, 274; 198/428, 198/689.1

See application file for complete search history.

(56) References Cited

U.S. PATENT DOCUMENTS 4,651,984 A * 3/1987 Emrich ..... 271/237
4,805,890 A * 2/1989 Martin ..... 271/203
5,100,124 A * 3/1992 Pouliquen ..... 271/183
5,139,253 A * 8/1992 Bohme et al. ..... 271/197
5,265,863 A * 11/1993 Becker ..... 271/183
5,697,608 A 12/1997 Castelli et al.
6,561,507 B1 * 5/2003 Pollock ..... 271/182

OTHER PUBLICATIONS

U.S. Appl. No. 11/528,770 to DeGruchy entitled "Sheet Buffering System" filed Sep. 27, 2006.

* cited by examiner

*Primary Examiner*—Patrick H Mackey
*Assistant Examiner*—Ernesto Suarez
(74) *Attorney, Agent, or Firm*—Oliff & Berridge, PLC

(57) ABSTRACT

A high speed sheet stacker includes a plurality of vacuum transport sub-assemblies interdigitated with an adjacent sub-assembly and provided with a spatial pitch that is less than or equal to a predetermined shingle distance. The collective vacuum transport assembly can thus acquire shingled sheets and transport the shingled sheets as a set, with each sheet being offset by at least one shingle distance. As a result, speed and acceleration requirements for the vacuum transport and the sheets being transported are greatly reduced compared to conventional vacuum transports that essentially transport sheets singularly. A shingled transport zone may be provided upstream of the vacuum transport system to accommodate sheets of varying size. In various embodiments, three to five vacuum transport sub-assemblies are provided to transport three to five sheets as a set.

19 Claims, 5 Drawing Sheets

HIGH SPEED SHINGLED SHEET COMPILER

BACKGROUND

A vacuum transport system provides shingled sheets across a stack prior to individually registering the sheets onto the stack. Shingling the sheets allows sheet and transport velocity and acceleration levels to be relatively low, and thus not stressful to transport drives and to the sheets. This allows an incoming sheet stream to be reliably stacked at a very high stack rate.

A basic finishing function for a production printer is a high capacity stacker. The purpose of the stacker is to compile printed sheets into a well-formed stack suitable to user end requirements, such as off-line finishing or bulk distribution. Current production printers are equipped with a high capacity stacker that produces a stack in which sheets can be optionally offset to one of two positions in the cross-process direction. This stacker design has proven effective and reliable at speeds of at least 110 ppm.

FIG. 1 shows a schematic of a conventional high capacity stacker. Sheets (unshown) enter from the left into the horizontal transport in area 1, pass through a mid transport in area 2 into a turn transport in area 3, after which the sheets are individually offset in the cross-process direction in area 4, and then pass onto a vacuum gripper transport (VGT) subsystem in area 5. The offset function may be performed via a nip pair similar to that used for print registration. An example of such an offset function can be found in U.S. Pat. No. 5,697,608 to Castelli et al., the disclosure of which is hereby incorporated herein in its entirety.

The conventional VGT transport consists of torso independently driven belt transport assemblies, VGT-1 and VGT-2, each having vacuum ports 240 (FIG. 2) and vacuum plenums 210 (FIG. 2) in order to successively acquire a leading edge of each sheet transported from offsetting nip 220 (FIG. 2) and then drag the sheet by its lead edge across the stack (right to left in the drawing) into a registration nip 230. At the registration nip 230, a series of scuffer belts 250 draw each lead edge up against a registration wall 260. The VGT thus acts much like a mechanical gripper system except that the gripping force is supplied solely by vacuum.

FIG. 2 shows a simplified view of a conventional VGT transport system 9200. Each VGT transport sub-assembly VGT-1 and VGT-2 has a multiplicity of belts spatially offset in the cross-process direction. The VGT-1 belts are interdigitated with the VGT-2 belts to enable sheets to smoothly transfer from VGT-1 to VGT-2. Each belt includes two sets of holes forming ports 240 located 180° apart from each other. When a set of holes 240 passes below the plenum areas 210 shown, vacuum will be transmitted from the plenum through the set of holes 240. If a sheet lead edge is aligned with the holes 240, the sheet will be acquired by the VGT-1 belts for transport by the belts. When the VGT-1 belt holes 240 pass out of the extreme left end of the first plenum zone 210, vacuum is no longer transmitted to the sheet. However, because the VGT-2 belts and plenum are sufficiently overlapped or abutting the VGT-1 belts and plenum, when the VGT-2 belt holes 240 pass the extreme right end of the second plenum 210, the sheet lead edge is acquired by the VGT-2 belts and transported further leftward. When the VGT-2 belt holes pass 240 out of the extreme left end of the plenum zone 210, vacuum is no longer transmitted to the sheet and it is released into the registration nip 230 where it is stacked against registration wall 260 by scuffer belts 250.

SUMMARY

Recent work has demonstrated the feasibility of even higher stacking rates beyond 110 ppm, for the conventional vacuum transport. Given the expected advances in high speed production printers, the requirement to reliably compile a stream of sheets at speeds exceeding 200 ppm will be desirable. Existing high capacity stacker technology is not easily extensible to such rates due to the needed speed of the sheets using the current singular transport of individual sheets through the vacuum transport.

The conventional VGT transport system operates in a stop/start cycle in which the belts are rapidly accelerated from a stop to a transport speed to acquire and transport a sheet. Then the vacuum transport must rapidly decelerate back to a stop position once for each transport cycle. As the processing speeds increase, the time interval for each cycle must be reduced, placing large dynamic forces on the sheets and transport components. These forces and speed increases have the possibility of causing high speed failure modes due to the potential for excessive kinetic energy. For example, excessive transport speed may cause bounce back of the sheet once it is rapidly stopped against the registration wall 260. Additionally, aerodynamic forces acting on the sheet may cause the sheet edge to experience turbulence or flapping. As an example of the forces and speeds experienced, at 270 ppm, it is estimated that the current VGT belts will need to reach speeds of about 2.4 m/s and accelerate at 6.1 g's if current start/stop pitch cycles are maintained. Even if the VGT belts were run continuously whenever possible, the vacuum transport belts (and thus the sheets) would still travel at a speed of about 1.95 m/s, which is over twice the current maximum sheet speed of about 0.95 m/s.

Because kinetic energy of sheets being registered would be quadrupled at such speeds, sheet bounce back and lead edge damage is much more likely to occur. Accordingly, a more robust approach to sheet transport across the stack is desirable to achieve increased processing rates of 200 ppm or more with reduced potential for sheet damage or system malfunction.

Thus, speeds attainable with singularly fed sheets have reached a ceiling that will be difficult to break though without material changes in transport mode. One possible mechanism to improve the speed would be to transport twice the sheets, such as by transporting two sheets at the same time. However, due to limitations of vacuum transport systems that rely on vacuum applied to portions of the top surface of a top sheet, reliable transporting of the lower sheet(s) is difficult.

In accordance with aspects of the disclosure, the existing vacuum gripper transport architecture is modified so that incoming sheets can be transported across the existing stack at a relatively slow speed, which can even be slower than the currently attainable speeds, yet provide registration on top of the stack at very high stacking rates. This makes the modified architecture particularly suited for reliably feeding sheets from a TIPP system feed from multiple imaging machines, such as production printers.

In certain exemplary embodiments, this can be achieved by allowing sheets to overlap each other prior to their acquisition onto a vacuum gripper transport (VGT). The overlapped or shingled sheets can then be serially acquired by vacuum ports on the VGT transport that are spaced the same distance apart as the shingled sheet lead edges. Such a distance is referred to as the shingle distance. Each vacuum transport operates in an intermittent stop/start mode once per pitch. However, each cycle only advances the sheet by one shingle distance. Alternatively, each vacuum transport may advance in unison at an appropriate continuous speed such that each sheet advances by the shingle distance each pitch. Because multiple vacuum transports operate concurrently and because of the shingling distance being shorter than sheet length, multiple sheets are effectively transported simultaneously by the collective vacuum transport system at a set (albeit each is offset by the shingling distance). As a result, the speed and acceleration requirements for the vacuum transport and the sheets being transported are greatly reduced compared to conventional vacuum transports that essentially transport sheets singularly.

In accordance with aspects of the disclosure, a high speed sheet stacker is provided including a plurality of vacuum transport sub-assemblies interdigitated with an adjacent sub-assembly and provided with a spatial pitch that is less than or equal to the shingle distance. The collective vacuum transport assembly can thus acquire shingled sheets and transport the shingled sheets as a set, with each sheet being offset by at least one shingle distance. As a result, speed and acceleration requirements for the vacuum transport and the sheets being transported are greatly reduced compared to conventional vacuum transports that essentially transport sheets singularly.

In accordance with aspects of the disclosure, at least two sheets are transported as a set by the vacuum transport system. In certain exemplary embodiments, this is achieved by providing at least two vacuum transport belt sub-assemblies, one for each sheet being transported as a set. However, in certain embodiments, five vacuum transport sub-assemblies have been found to be optimal to achieve sufficient transport speed while not excessively increasing the size and complexity of the stack handler.

In accordance with further aspects of the disclosure, a shingled transport zone is provided upstream of the vacuum transport sub-assemblies that includes a plurality of nips spaced in the process direction to pre-position sheets of two or more lengths for transport to the vacuum transport subassemblies. In certain embodiments, there may be three nips to accommodate small, medium and large length sheets, in which at least two of the three include a nip release mechanism to allow the sheets to readily pass thereby. In other embodiments, at least five nips are provided to accommodate at least two additional intermediate sheet sizes. In this latter embodiment, four of the five nips may be openable by including a nip release mechanism.

In accordance with further aspects of the disclosure, an offsetting function for offsetting the sheets in a cross-process direction is provided upstream of the shingled transport zone. In certain embodiments, this can be provided in a turn baffle.

In an exemplary embodiment, a vacuum transport system for transporting a set of sheets to a registration zone is provided that includes: a shingling loading zone; a shingled transport zone; and a vacuum transport assembly. The shingling loading zone receives singular incoming sheets at a predetermined speed and outputs sequential sheets that are optionally shifted on a sheet-by-sheet basis laterally in a cross-process direction. The shingled transport zone is of a length sufficient to accommodate at least one maximum sheet length, and includes at least one pinch nip that slows down the incoming sheets and shingles the incoming sheets by a predetermined shingle distance, the at least one pinch nip having a transport profile that transports the shingled sheets in unison at a reduced speed in the process direction. The vacuum transport assembly includes at least two vacuum transport belt subassemblies, each sub-assembly including a plurality of belts spatially separated in the cross-process direction, the belts of each sub-assembly being interdigitated with belts of an adjacent sub-assembly, the sub-assemblies being provided with a spatial pitch less than or equal to a shingle distance and defining an overlap region between adjacent sub-assemblies. Belts of each vacuum transport sub-assembly include at least one vacuum port in contact with a vacuum plenum to acquire a leading edge of a sheet, the collective vacuum transport assembly being advanced to transport a shingled set of multiple sheets though the vacuum transport assembly simultaneously. Each sheet is separated by at least one shingle distance, and the last vacuum transport sub-assembly in the process direction transports a single sheet into the registration zone.

The vacuum transport system may be part of a sheet stacker, including a tray for receiving stacked sheets provided in the registration zone.

In an exemplary embodiment, a method for transporting a set of sheets to a registration zone is provide that includes:

receiving singular incoming sheets at a predetermined speed at a loading zone and outputting sequential sheets that are optionally shifted on a sheet-by-sheet basis laterally in a cross-process direction;

receiving the offset sheets in a shingled transport zone of a length sufficient to accommodate at least one maximum sheet length and slowing the sheets to a transport speed;

shingling a set of sheets in the shingled transport zone by a predetermined shingle distance and transporting the set of sheets in the process direction to a vacuum transport assembly including at least two vacuum transport belt subassemblies, each sub-assembly including a plurality of belts spatially separated in the cross-process direction, the belts of each sub-assembly being interdigitated with belts of an adjacent sub-assembly, the sub-assemblies being provided with a spatial pitch less than or equal to a shingle distance and defining an overlap region between adjacent sub-assemblies, wherein belts of each vacuum transport sub-assembly include at least one vacuum port in contact with a vacuum plenum to acquire a leading edge of a sheet;

collectively transporting the set of shingled sheets simultaneously thorough the vacuum transport system; and advancing each successive shingled sheet of the set into a registration zone singularly.

BRIEF DESCRIPTION OF THE DRAWINGS

Exemplary embodiments will be described with reference to the drawings, wherein.

DETAILED DESCRIPTION OF EMBODIMENTS

Figure 1:
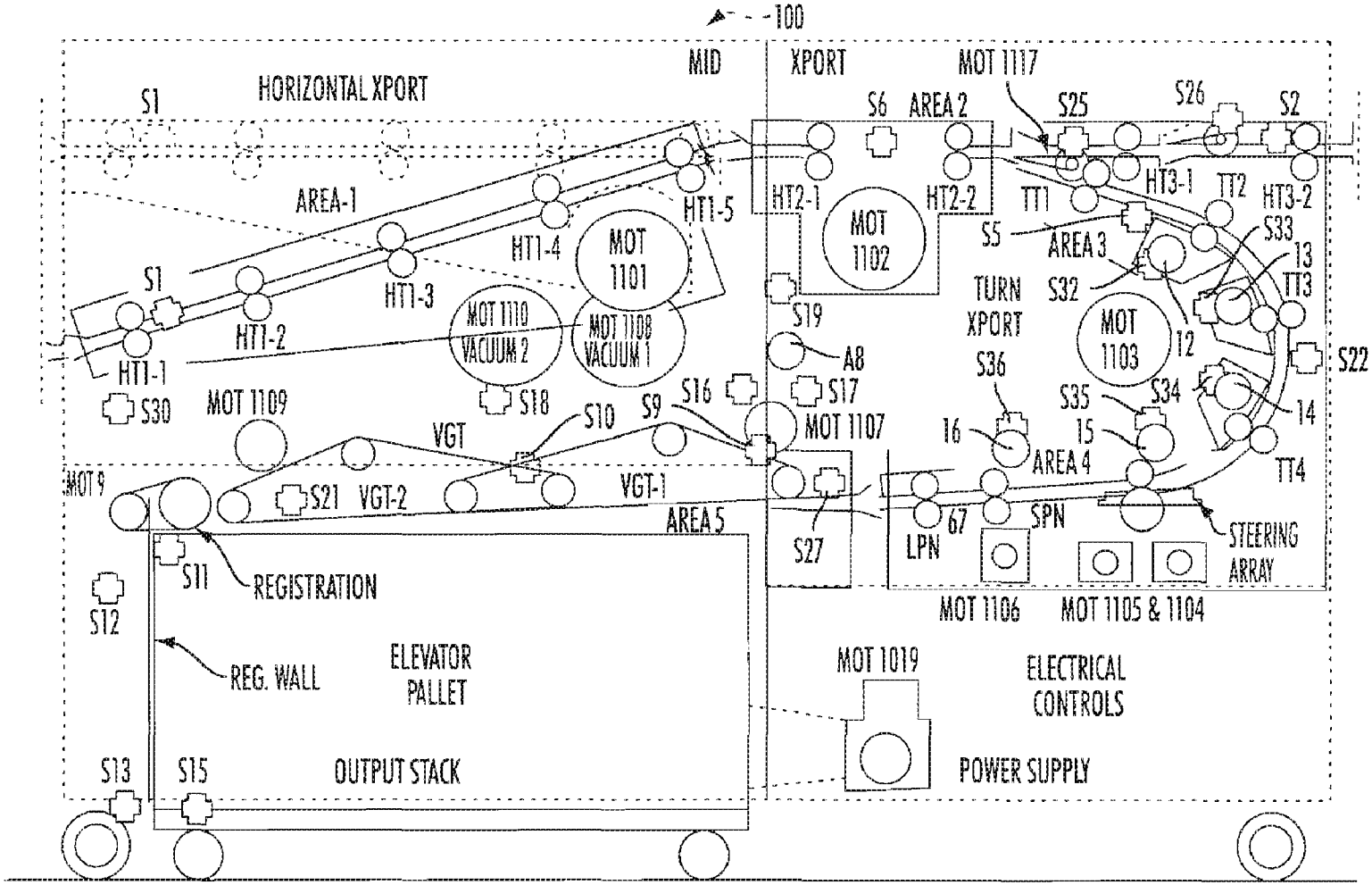
FIG. 1 RELATED ART
FIG. 1 is a cross-sectional view of conventional high capacity stacker for transporting and registering sheets from an imaging machine, such as a production printer.

A first embodiment of a shingled vacuum transport system 300 will be described with reference to FIGS. 3-6. Shingled vacuum transport system 300 includes a shingling/loading zone 310, a shingled transport zone 320, a vacuum transport zone 340, and a registration zone 350.

Figure 3:
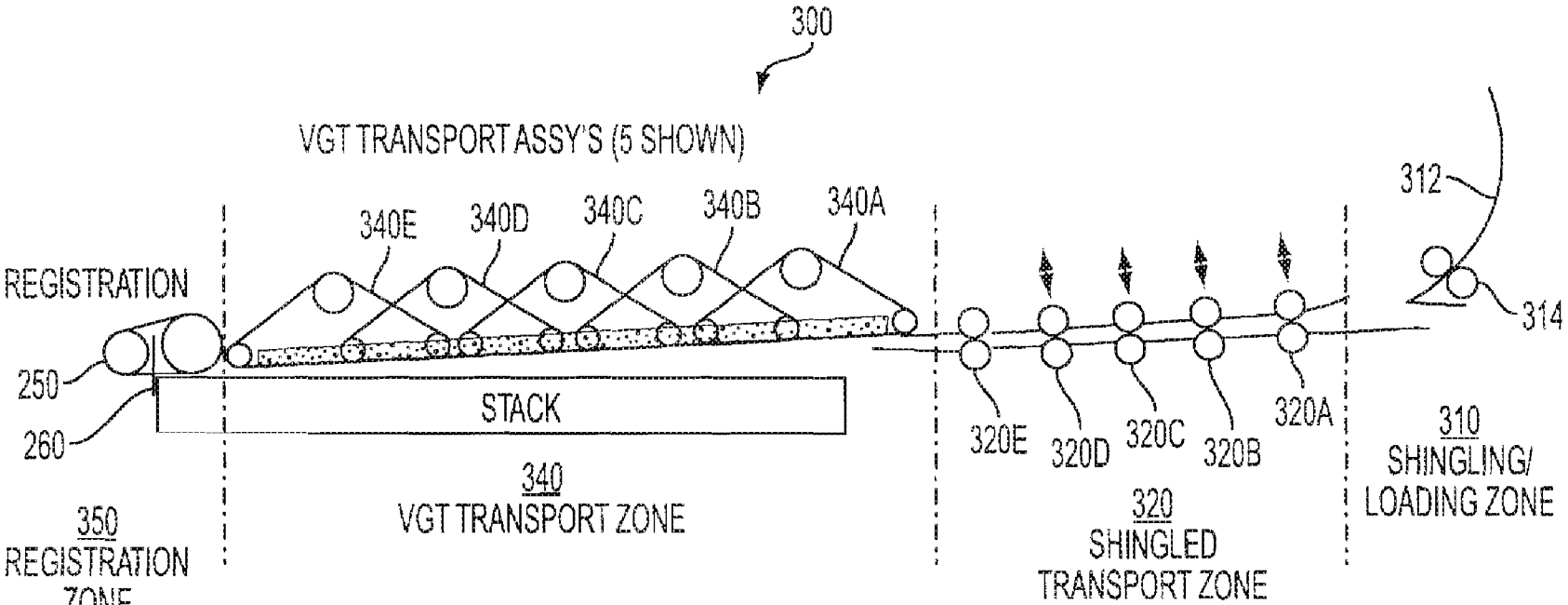
FIG. 3 is a cross-sectional view of an exemplary embodiment of a shingled vacuum transport system.

Sheets are fed from one or more imaging machines into a sheet stacker 100, such as the one shown in FIG. 1 modified to include the shingled vacuum transport system 300 of FIG. 3. Once in the stacker, individual sheets are fed at a relatively high processing speed, such as about 1.5 m/s, into the shingling/loading zone 310. This zone is provided to optionally laterally offset sequentially fed sheets of paper and to properly guide and control the speed of the sheet as it is fed to shingled transport zone 320. Each sheet is optionally offset by a translation stage capable of shifting sheets laterally on a sheet-by-sheet basis within a turn baffle 312 within zone 310. A suitable offset device can be found, for example, in U.S. Pat. No. 5,697,608. Other suitable offset devices can also be used. The sheets travel through the turn baffle 312 at a high speed (~1.5 m/s) until the sheet's trail edge approaches the end of the turn baffle 312. At this point, the sheet is decelerated to a suitable shingle transport speed. In an exemplary embodiment, this speed is about 0.5 m/s, but can be slower and/or faster.

As the sheet trail edge clears the turn baffle 312, strain energy is released and the trail edge 'flicks' downward below the turn baffle. If desired to allow for curl latitude, a low airflow can be maintained oriented vertically downward to encourage curled trail edges to 'flick'. In general, there will be previous sheets already in the shingled transport zone 320, so the incoming sheet is actually impinging upon and being guided on top of the previously fed sheet.

As sheets enter the shingled transport zone 320, they become shingled such that an upper sheet's lead edge always trails a lower sheet's lead edge by a predetermined distance, referred to as the shingle distance. All shingled sheets travel in unison via a set of pinch nips 320A-E operating with either a stop/start profile or a continuous velocity. Each of pinch nips 320A-E, with the exception of the leftmost nip 320E, has a nip release mechanism that allows the nip to controllably open or close. In the embodiment shown, the nip release is formed by a mechanism that allows at least one of the two nip roller pairs to be displaced relative to the other by a distance that allows the sheet to freely pass therebetween. For example, one or both of the roller pairs may be biased away from the other by a solenoid and a spring used to return a predetermined nip spacing upon release of the solenoid. The nip releases are used to allow different lengths of media to enter the correct distance into the shingled transport zone 320 at high speed before decelerating. That is, the zone 320 is sized to accommodate the longest size sheet so that it is fully received within the zone (i.e., is allowed to exit loading zone 310 and "flick"). Although five nips 320A-E are shown, lesser or greater numbers can be provided depending on the flexibility of the system for accommodating alternative sheet sizes. For example, three nips could be provided to accommodate small, medium and large sheet sizes.

In the example shown, for the largest sheet size, such as a 20.5" long sheet, all of nips 320A-D may open to allow the sheet to fully enter before decelerating and loading. For a smallest sheet size, such as a 7" long sheet, all of nips 320A-E can remain closed so that the sheet is initially decelerated and acquired by nip 320A. Intermediate sheet sizes can have a fewer number of nips closed.

From the shingled transport zone 320, the shingled sheets are fed to the vacuum transport zone 340, where they remain shingled as they transport across the stack via a stop/start transport motion once per system pitch cycle (or could use a continuous transport profile). Each sheet's lead edge is acquired by holes 344 on one or more spatially offset belts of the first vacuum transport sub-assembly 340A, whereupon the sheet is transported to overlap region 345 (FIG. 6) where holes 344 of one or more spatially offset belts of the second vacuum transport sub-assembly 340B acquire the leading edge while the holes 344 of the first vacuum transport release hold of the leading edge to effect transfer. This process continues through each of the multiple vacuum transport sub-assemblies 340A-E. Thus, for example, when there are five vacuum transport sub-assemblies 340A-E as shown, there can be up to five sheets being transported simultaneously in the collective vacuum transport system. However, as few as two vacuum transport sub-assemblies can be used and still achieve benefits of shingled transport of multiple sheets as a set for a single sheet length stacker configuration.

Figure 2:
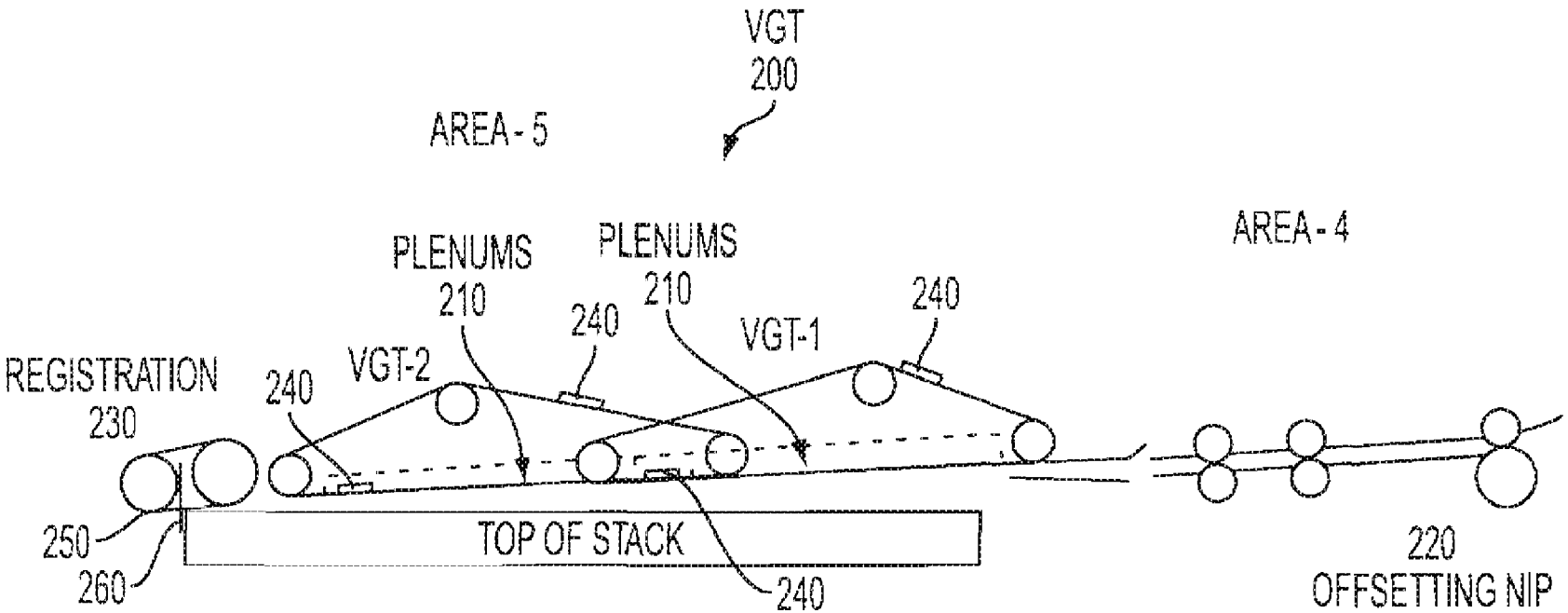
FIG. 2 RELATED ART
FIG. 2 is a simplified cross-sectional view of a conventional vacuum gripper transport system.
Figure 4:
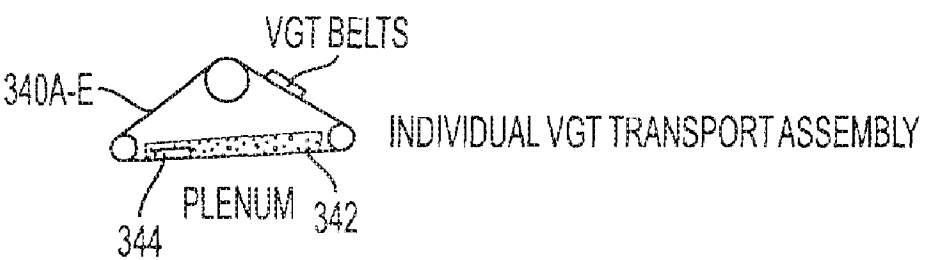
FIG. 4 is a view of an individual vacuum transport sub-assembly from FIG. 3.

The vacuum transport belt sub-assemblies 340A-E can be similar in design to the ones used in conventional FIG. 2. However, they are sized to be more compact so that they can be arrayed along the sheet travel direction on a spatial pitch that is less than or equal to the shingle distance so as to allow transport of more than 1 sheet by the vacuum transport system at one time (albeit offset by the shingling distance). An individual vacuum transport sub-assembly is shown in FIG. 4.

During operation, each sheet's lead edge will be advanced by an upstream vacuum transport belt sub-assembly (one of subassemblies 340A-E) and transferred to the next downstream vacuum transport belt sub-assembly. The speed and acceleration rate for this indexing motion can be modest and still achieve stacking rate equal to or well in excess of conventional stacking rates of the system of FIG. 2. As a non-limiting example, if the shingle distance is 100 mm, then 270 ppm productivity can be supported with an indexing profile using a transport speed of about 0.5 m/s and 2 G's acceleration. Alternatively, a relatively low continuous speed can be used. Lower or higher transport speeds can be used. However, this illustration shows how improved stacking rates can be achieved with a lower effective sheet speed than the system of FIG. 2. Also, as the number of vacuum transport sub-assemblies is increased, the total number of sheets being simultaneously transported is increased (each sheet being offset by the shingling distance). This increases the effective sheet handling capability of the system without increasing sheet advance speed due to the transfer of a shingled "set" of sheets simultaneously.

As the sheet exits the left-most vacuum transport belt sub-assembly 340E, its lead edge is no longer tacked by vacuum to the transport belts and the sheet enters the registration zone 350. The registration scuffer belts 250 then cycle on and drive the lead edge up against the stack registration wall 260. Because the sheet speed is relatively low, there are no issues with sheet damage or bounce back. Thus, reliable transport and stacking can be achieved. Testing performed suggests that there is sufficient time to fully register each sheet within the available pitch cycle at even speeds well in excess of 200 ppm (at a pitch cycle of about 0.222 sec).

Figure 5:
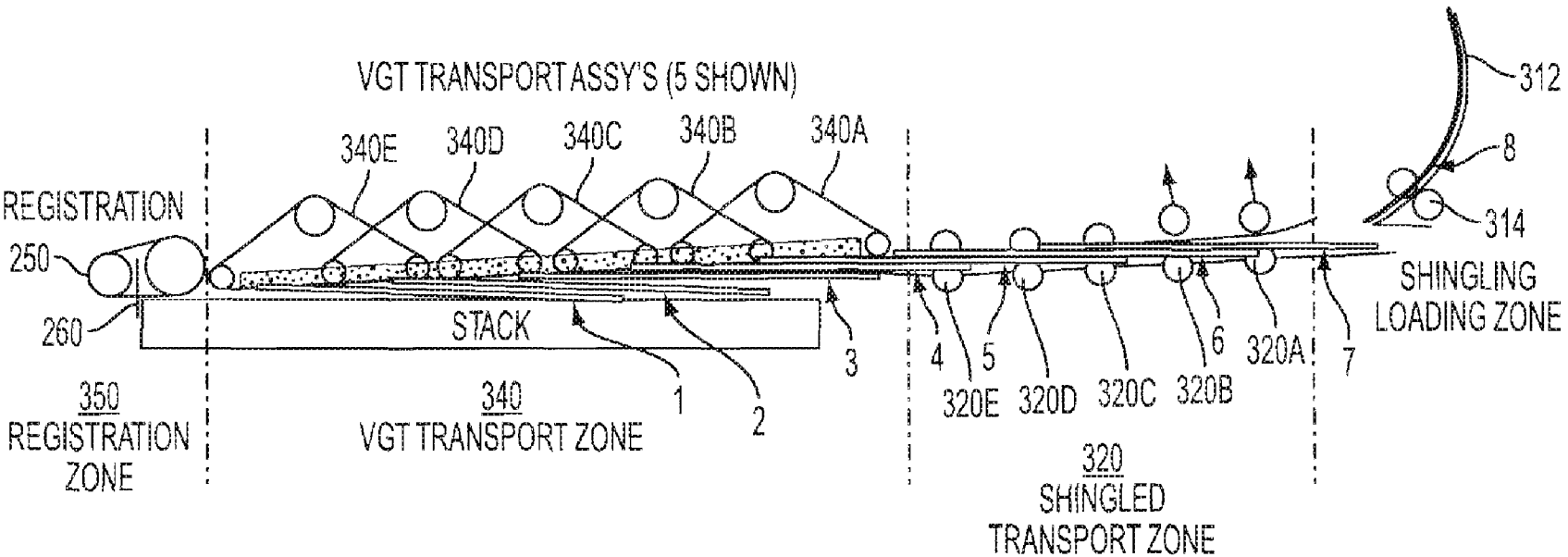
FIG. 5 is a cross-sectional view of the shingled vacuum transport system of FIG. 3 showing advancement of eight (8) sheets through the transport.
Figure 6:
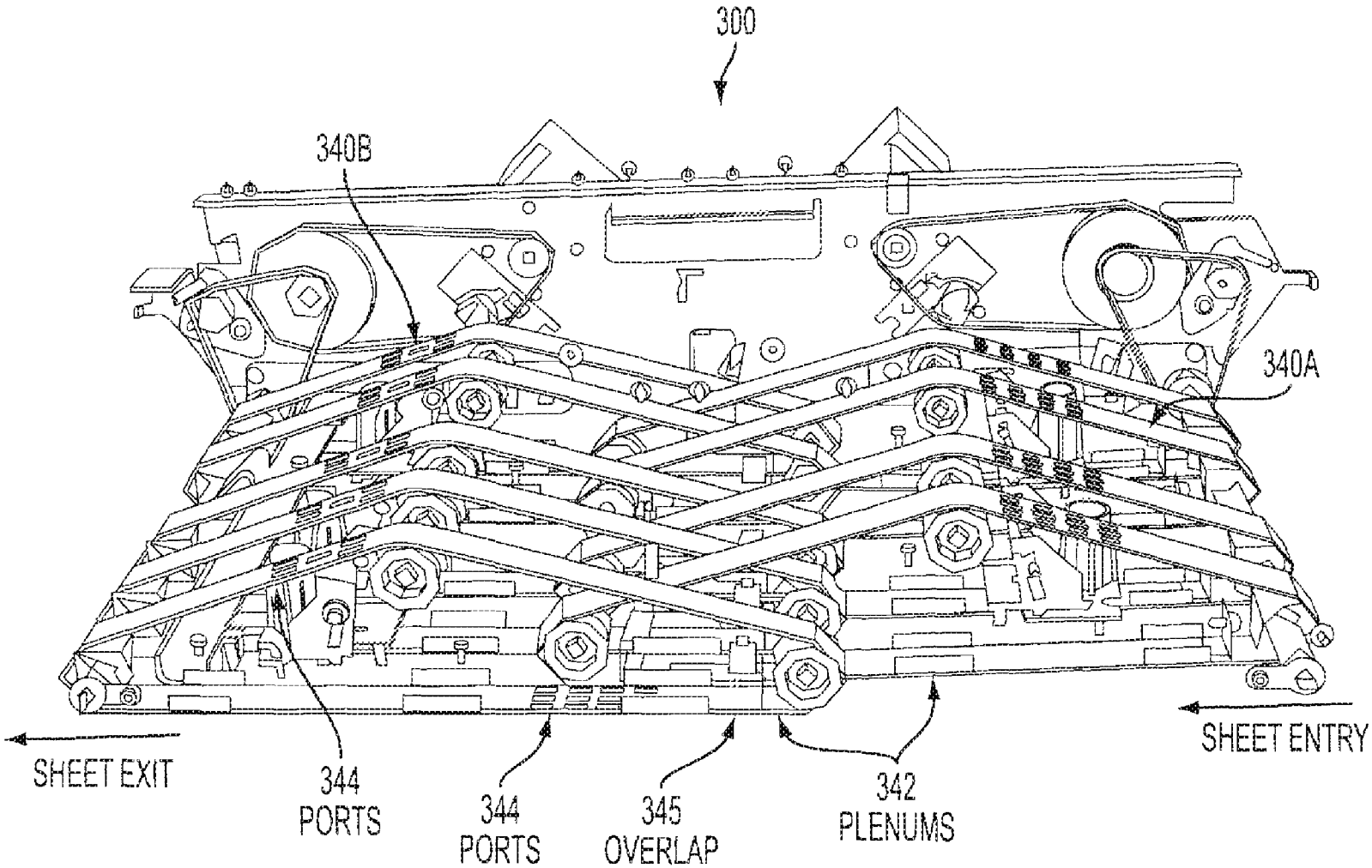
FIG. 6 is a simplified exemplary perspective view of aspects of the vacuum transport system showing two adjacent vacuum transport belt regions, each having individual belts spatially separated in the cross-process direction and the belts of each region or sub-system being interdigitated.

FIG. 5 below illustrates a typical operating state for medium pitch size sheets. Note that sheet 1 is ready to enter the registration nip in registration zone 350 on the next pitch cycle. Sheet 7 has just decelerated and its trail edge has dropped below the turn baffle. Sheet 8 is about to impinge upon the top side of sheet 7 at high speed. The right-most two nips 320A, 320B within the shingling transport zone 320 are open to allow sheets of this length to properly shingle.

The basic steady state behavior of the shingling transport 320 and vacuum transport 340 are rather straightforward. However, there are certain use cases that require slightly different behavior. A few of the more typical cases are described below:

The first sheet in a job can be handled normally until its lead edge is ready to be acquired by the rightmost vacuum transport sub-assembly 340A. Since no sheets precede it, the vacuum ports 344 of the other vacuum transport belt sub-assemblies 340B-E will be open and thus proper sealed port pressure may not be achieved for the sheet (if the vacuum transport belt sub-assemblies share a high capacity vacuum blower). In this event, the unused vacuum transport belt sub-assemblies (340B-E) can all be parked in a sealed port condition so that their belt holes 344 do not line up with their plenums 342. That is, both spaced ports 344 formed by holes in the belt (best shown in FIG. 6) may be oriented about the belt so as to be spaced from plenum, 342. As the first sheet travels to the left across the vacuum transport zone 340, successive vacuum transport belt sub-assemblies (340B-E) will start up to accept the sheet.

The system must also act differently to accommodate the last sheet in a job. In this case, there are no sheets following the last sheet. En an analogous manner to the first sheet example, after each vacuum transport belt sub-assembly passes the sheet lead edge to its left neighbor, it parks at a park position so as to seal off its plenum 342. The last sheet therefore behaves just as any other sheet once it arrives at registration zone 350.

Skipped pitches or photoreceptor seam pitches in a job are other areas that may require special handling. In this case, there is a gap in the incoming stream of sheets due to either a skipped pitch or a photoreceptor seam pitch (a large intercopy gap that occurs once each photoreceptor belt revolution). In either event, the stacker response is made to delay advancing the shingled sheets in both the shingled transport zone 320 and the vacuum transport zone 340 until the next sheet arrives. Once the next sheet arrives, it is stopped at the usual point and normal motion of the shingled sheets can resume.

Mixed length media may also require special handling. If a smaller length sheet follows a larger sheet, the stacker can accommodate this by closing down the shingled transport nips 320A-E as appropriate and parking the next sheet. Depending on its size, the sheet lead edge may be 'N' shingle distances behind the previous sheet's lead edge, which the stacker treats as 'N' skipped pitches between the sheets. If a larger length sheet follows a smaller sheet, the system will need to schedule an appropriate number of skipped pitches between them so that the prior sheet is allowed to first index far enough into the shingled transport zone so that the larger sheet can be properly parked.

Because of the presence of shingled sheets in the shingled transport zone 320, it is difficult to achieve desirable cross-process offsetting of the sheets. Accordingly, in exemplary, embodiments, the offsetting function is achieved upstream from the shingled transport zone 320. For example, an offsetting transport can be provided at loading zone 310, such as provided at turn baffle 312. The offset function can be achieved using a simple translating nip with a nip release. Therefore, sheets can be optionally offset inboard or outboard prior to arriving at the shingling transport zone 320.

It will be appreciated that various of the above-disclosed and other features and functions, or alternatives thereof may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A sheet transport system for transporting a set of sheets to a destination zone, comprising:

a shingling loading zone that receives singular incoming sheets at a predetermined speed and outputs sequential sheets into a shingled transport zone;

a shingled transport zone of a length sufficient to accommodate at least one maximum sheet length, the shingled transport zone including at least one transport device including shingling means for slowing down the incoming sheets and shingling the incoming sheets such that an upper sheet leading edge trails a lower sheet trailing edge by a predetermined shingle distance, the at least one transport device having a transport profile that transports the shingled sheets in unison at a reduced speed in a process direction;

a vacuum transport assembly including at least two vacuum transport sub-assemblies, the sub-assemblies being provided with a spatial pitch less than or equal to the shingle distance, each sub-assembly including a plurality of belts spatially separated in the cross-process direction, the belts of each sub-assembly being interdigitated with belts of an adjacent sub-assembly, wherein each vacuum transport sub-assembly is located above the shingled sheets and includes means for acquiring a top leading edge of only a single sheet of the shingled sheets, the collective vacuum transport assembly being advanced to transport a shingled set of multiple sheets through the vacuum transport assembly simultaneously, with each vacuum sub-assembly acquiring and transporting only a single sheet of the set of multiple sheets with each sheet being separated by at least one shingle distance, and the last vacuum transport sub-assembly in the process direction transports a single sheet into the destination zone.

2. The sheet transport system according to claim 1, wherein the vacuum transport assembly includes at least three vacuum transport sub-assemblies that simultaneously transport three shingled sheets as a set.

3. The sheet transport system according to claim 2, wherein the vacuum transport assembly includes at least five vacuum transport sub-assemblies transport five shingled sheets as a set.

4. The sheet transport system according to claim 1, wherein each vacuum port includes a park zone where the vacuum port is removed from communication with the plenum.

5. The sheet transport system according to claim 1, wherein the shingled transport zone includes at least two pinch nips spaced in the process direction to accommodate sheets of at least two sizes in the shingled transport zone.

6. The sheet transport system according to claim 5, wherein at least three pinch nips are provided to accommodate small, medium and large sheet sizes and wherein at least one of the pinch nips includes a nip release mechanism.

7. The sheet transport system according to claim 5, wherein at least five pinch nips are provided to accommodate small, medium, large and two intermediate sheet sizes and wherein at least three of the pinch nips includes a nip release mechanism.

8. The sheet transport system according to claim 1, wherein the shingling loading zone includes a turn baffle that causes each sheet's trailing edge to flick upon exit from the shingling loading zone to release strain energy from the sheet.

9. The sheet transport system according to claim 1, wherein the shingling loading zone includes an offsetting device that offsets sheets on a sheet-by-sheet basis laterally in a cross-process direction.

10. A sheet stacker, comprising:

a tray for receiving stacked sheets;

a registration zone for stopping and registering singular sheets on top of the tray; and a sheet transport system including, a shingling loading zone that receives singular incoming sheets at a predetermined speed and outputs sequential sheets into a shingled transport zone;

a shingled transport zone of a length sufficient to accommodate at least one maximum sheet length, the shingled transport zone including at least one transport device that slows down the incoming sheets and shingles the incoming sheets such that an upper sheet leading edge trails a lower sheet trailing edge by a predetermined shingle distance, the at least one transport device having a transport profile that transports the shingled sheets in unison at a reduced speed in a process direction;

a vacuum transport assembly including at least two vacuum transport sub-assemblies, each sub-assembly including a plurality of belts spatially separated in the cross-process direction, the belts of each sub-assembly being interdigitated with belts of an adjacent sub-assembly, the sub-assemblies being provided with a spatial pitch less than or equal to a shingle distance, wherein each vacuum transport sub-assembly is located above the shingled sheets and includes means for acquiring a top leading edge of only a single sheet of the shingled sheets, the means for acquiring including at least one vacuum port in contact with a vacuum plenum to acquire the top leading edge of the single sheet, an overlap region being defined between two adjacent sub-assemblies where at least one vacuum port of each of the two adjacent sub-assemblies overlaps in the process direction, the collective vacuum transport assembly being advanced to transport a shingled set of multiple sheets through the vacuum transport assembly simultaneously, with each vacuum sub-assembly acquiring and transporting only a single sheet of the set of multiple sheets with each single sheet being separated by at least one shingle distance, and the last vacuum transport sub-assembly in the process direction transports a single sheet into the registration zone.

11. The sheet stacker according to claim 10, wherein the vacuum transport assembly includes at least three vacuum transport sub-assemblies that simultaneously transport three shingled sheets as a set.

12. The sheet stacker according to claim 10, wherein the shingled transport zone includes at least two pinch nips spaced in the process direction to accommodate sheets of at least two sizes in the shingled transport zone.

13. A method for transporting a set of sheets to a destination zone, comprising:

receiving singular incoming sheets at a predetermined speed at a loading zone and outputting sequential sheets into a shingled transport zone;

receiving the sheets in a shingled transport zone of a length sufficient to accommodate at least one maximum sheet length and slowing the sheets to a transport speed;

shingling a set of sheets in the shingled transport zone such that an upper sheet leading edge trails a lower sheet trailing edge by a predetermined shingle distance and transporting the set of sheets in a process direction below a vacuum transport assembly including at least two vacuum transport sub-assemblies, each sub-assembly including a plurality of belts spatially separated in the cross-process direction, the belts of each sub-assembly being interdigitated with belts of an adjacent sub-assembly, the sub-assemblies being provided with a spatial pitch less than or equal to the shingle distance, wherein each vacuum transport sub-assembly includes at least one vacuum port in contact with a vacuum plenum to acquire a leading edge of a sheet;

collectively transporting the set of shingled sheets simultaneously through the vacuum transport system with each vacuum sub-assembly acquiring and transporting only a single sheet of the set of shingled sheets; and advancing each sheet of the set of shingled sheets into a destination zone singularly.

14. The method according to claim 13, wherein a set of at least three sheets is transported at the same time through the vacuum transport assembly.

15. The method according to claim 13, wherein a set of at least five sheets is transported at the same time through the vacuum transport assembly.

16. The method according to claim 13, further comprising stacking sheets at the destination zone.

17. The method according to claim 13, wherein the shingled transport zone includes at least two pinch nips spaced in the process direction to shingle sheets of at least two least two sizes in the shingled transport zone.

18. The method according to claim 17, wherein the shingled transport zone includes at least three pinch nips, and at least two of the nips include a nip release mechanism to shingle sheets of at least three sizes in the shingled transport zone.

19. The method according to claim 13, wherein the shingling loading zone includes a turn baffle that causes each sheet's trailing edge to flick upon exit from the shingling loading zone to release strain energy from the sheet.

* * * * *